US006303539B1

(12) United States Patent
Kosarew

(10) Patent No.: US 6,303,539 B1
(45) Date of Patent: Oct. 16, 2001

(54) PRINTABLE SHEETS WHICH FORMS DUPLICATE COPIES AND METHODS FOR PRODUCING AND USING SAME

(75) Inventor: W. Tony Kosarew, Centerville, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/461,577

(22) Filed: Dec. 15, 1999

(51) Int. Cl.[7] ..... B41M 5/40

(52) U.S. Cl. ..... 503/201; 427/150; 427/152; 503/204; 503/206; 503/226

(58) Field of Search ..... 503/204, 206, 503/226, 200, 201; 427/150, 152

(56) References Cited

U.S. PATENT DOCUMENTS

| | | | |
|---|---|---|---|
| 4,046,404 | 9/1977 | Treier | 282/27.5 |
| 4,853,256 | 8/1989 | Obringer et al. | 427/152 |
| 4,938,505 | 7/1990 | Gruttemeyer et al. | 282/12 R |
| 5,279,875 | 1/1994 | Juszak et al. | 428/42 |
| 5,334,571 | 8/1994 | Baxter | 503/226 |
| 5,686,159 | 11/1997 | Langan | 428/40.1 |

*Primary Examiner*—Bruce H. Hess
(74) *Attorney, Agent, or Firm*—Millen White Zelano & Branigan, P.C.

(57) ABSTRACT

Business forms that provide duplicate images in heat fusing toner printers which comprise a base sheet and a thermosensitive, image-forming coating positioned on the base sheet followed by a top sheet, such as a label laminate. The thermosensitive, image-forming coating contains a thermally-activated, color-forming dye which can be activated at a temperature in the range of 90° F. to 135° F. The top sheet has a weight and thickness which permits heat to be conducted from a heat-fused toner-based image printed thereon to the thermosensitive, image-forming coating so as to raise the temperature of the underlying portions of the thermosensitive, image-forming coating by at least 20° F. In preferred embodiments, the top sheet is a label laminate. Methods for preparing such printable sheets and use of such printable sheets to obtain duplicate images are also provided.

15 Claims, 2 Drawing Sheets

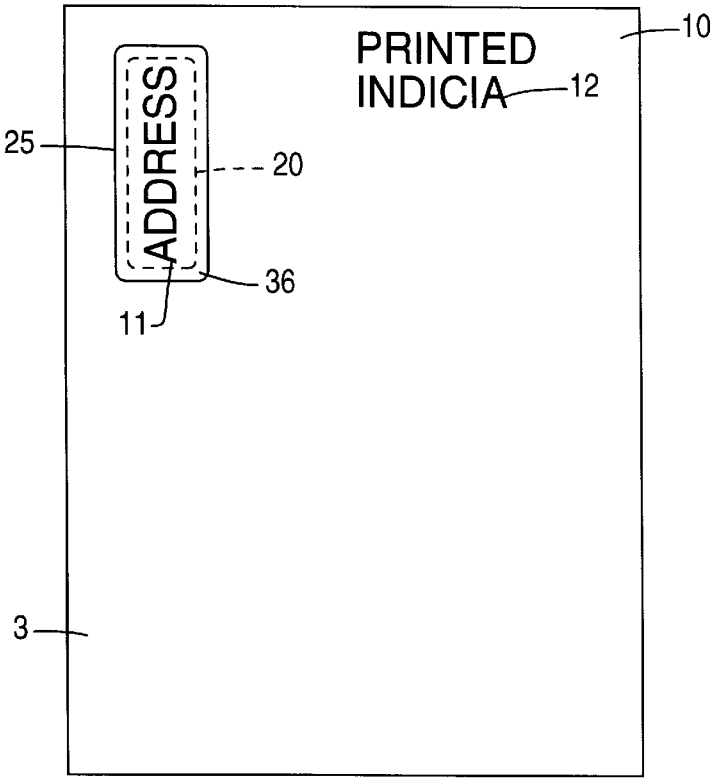
FIG. 3
FIG. 4
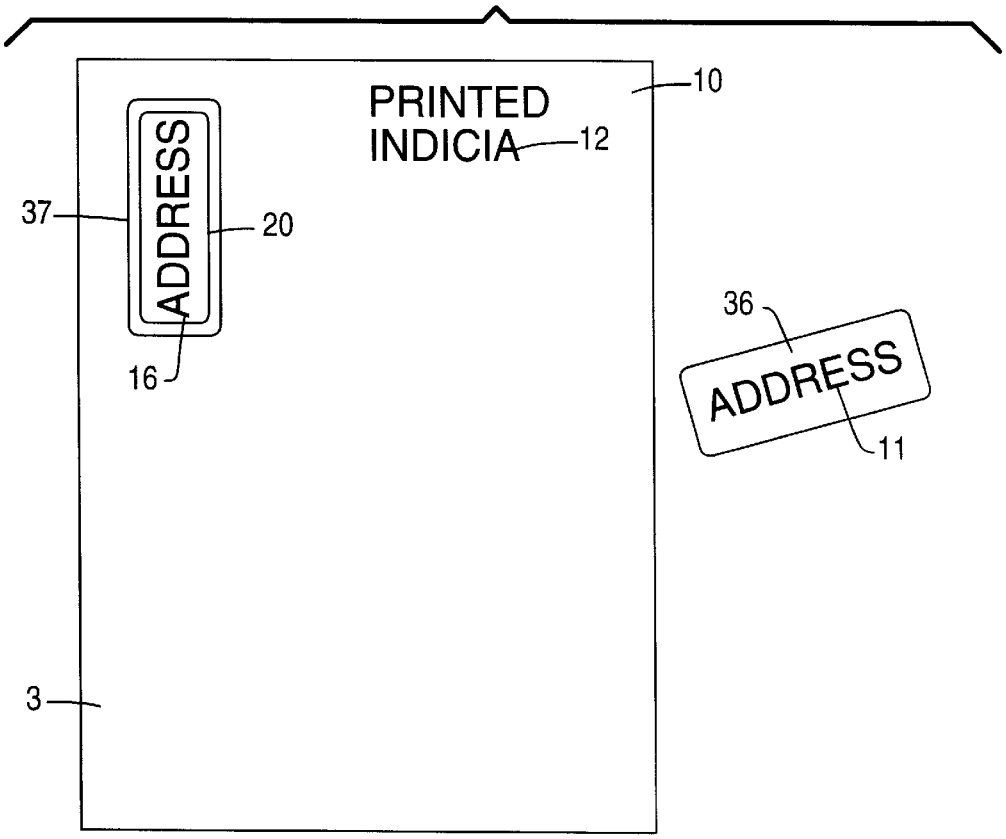

PRINTABLE SHEETS WHICH FORMS DUPLICATE COPIES AND METHODS FOR PRODUCING AND USING SAME

FIELD OF THE INVENTION

The present invention is directed to a printable sheet such as a business form having a base sheet and a separable top sheet wherein images printed on the top sheet are duplicated on the base sheet without carbon paper. The invention is also directed to a method for preparing these printable sheets and a method for using these printable sheets to make duplicate copies.

BACKGROUND OF THE INVENTION

In the manufacture of printable sheets such as business forms, there are many circumstances in which it is desirable to print duplicate information on multiple sheets. This includes printing duplicate information on adhesive labels.

Carbonless-paper forms which transfer images from a top sheet to a base sheet by impact methods or thermal printing methods are well known. Chemical carbonless paper functions by bringing together colorless components that react to produce a legible image. In most carbonless papers, the chemical reaction is similar to that of litmus paper changing color when placed in contact with an acid or alkaline solution. Proper functioning of the chemical carbonless paper is dependent on some means of preventing the colorless components from meeting and reacting until this color-producing reaction is desired. A common method of accomplishing this is through the encapsulation of one of the two components of the image-producing chemical system.

Generally, chemical carbonless papers are prepared in three configurations. One is the coated back (CB) configuration, wherein a sheet of paper has a coating of capsules containing color formers and oil solution, binders and other materials on the back of the sheet. A second configuration is coated front (CF), wherein a sheet of paper has a coating of color developing materials on the front of the sheet. A third configuration is front and back (CFB) which comprises a sheet of paper with a coating of color developers on its front surface and color-forming capsules on its back surface.

When using carbonless paper for impact printers, the pressure applied to the top sheet upon impact of the printhead transfers to the base sheet and any intermediate plies. The localized increase in pressure results in the rupture of the capsules which contain reactive compounds within these sheets. Migration of these compounds, either from sheet to sheet or within the same sheet, results in a reaction of these compounds and the generation of color within a pattern of the original image. Examples of such carbonless forms are described in U.S. Pat. No. 4,938,505, issued to Gruttemeyer et al; U.S. Pat. No. 4,046,404, issued to Treier; U.S. Pat. No. 5,279,875, issued to Juszak et al. and U.S. Pat. No. 5,334,571, issued to Baxter.

The carbonless-paper forms used in direct thermal printers or thermal transfer printers typically comprise multiple layers which contain a thermosensitive coating. These coatings contain thermally activated, color forming compounds which change color by the application of heat from a thermal printhead. The resistors within a thermal printhead rapidly heat the surface to temperatures typically in excess of 140° F. Examples of multilayer recording media with thermosensitive, color forming coatings are described in U.S. Pat. No. 4,853,256, issued to Obringer et al and U.S. Pat. No. 5,686,159 issued to Langan.

With the ability to generate duplicate images with multilayer printable sheets, the space available for other information is increased. For example, the printable sheets with multiple integrated removable labels described in U.S. Pat. No. 5,686,159 need not provide space for each label to reproduce the printing on each label since duplicates of the printed image are formed on underlying labels. It is desirable to extend this capability to heat fused toner-based printing methods.

Carbonless papers which can be used in non-impact laser printing and electrostatographic copiers are disclosed in U.S. Pat. Nos. 5,334,571 and 4,046,404, respectively. However, the images formed with these printers are not duplicated. Separate sheets are printed within these printers and then assembled to form a multi-part form. The duplication process achieved with these carbonless papers is accomplished after the forms are assembled.

It is desirable to provide a multilayer printable sheet which will form duplicate images within a heat fusing toner printer such as a laser printer.

SUMMARY OF THE INVENTION

It is an object of the present invention to provide a printable multilayer sheet which will provide duplicate copies of heat fused toner-based images printed thereon.

It is another object of the present invention to provide a printable sheet having an integral removable label which will provide duplicate copies of heat fused toner-based images printed on the label.

It is an additional object of the present invention to provide a method for preparing a printable sheet which forms duplicate copies of heat fused toner-based images printed thereon.

A further object of the present invention is to provide a method of forming at least one duplicate copy of a heat fused toner-based image when printing the image.

These and other objects will be apparent from the description and claims which follow. The above objects are achieved through the printable sheets, and methods of this invention.

In one aspect of this invention, there is provided a printable sheet having multiple separable layers comprising:

(a) a base sheet having a front face capable of receiving heat fused toner-based print thereon;

(b) a thermosensitive, image-forming coating positioned on the front face of said base sheet which contains a thermally-activated, color-forming dye that can be activated at a temperature in the range of 90° F. to 135° F.; and (c) a separable top sheet positioned on the base sheet over the thermosensitive, image-forming coating. The top sheet has a front face capable of receiving heat fused toner-based print thereon and has a weight and thickness (density) which permits sufficient heat to be conducted from a heat fused toner-based image printed thereon to the thermosensitive image-forming coating so as to raise the temperature of the underlying portions of the thermosensitive, image-forming coating by at least 20° F.

In a preferred aspect of this invention, there is provided a printable sheet having at least one integral label associated therewith and removable therefrom comprising:

(a) a base sheet having a front face capable of receiving heat fused toner-based print thereon;

(b) a thermosensitive, image-forming coating positioned on the front face of said base sheet which contains a thermally-activated, color-forming dye that can be activated at a temperature in the range of 90° F. to 135° F.; and (c) a label laminate positioned on the base sheet over the thermosensitive, image-forming coating. The label laminate comprises a face stock as a top lamina having a front face capable of receiving heat fused toner-based print thereon, a pressure-sensitive adhesive layer positioned on the rear face of the face stock and a silicone release layer which covers the pressure sensitive adhesive. The label laminate is of a thickness which permits sufficient heat to be conducted from a heat fused toner-based image printed thereon to the thermosensitive, image-forming coating to raise the temperature of underlying portions by at least 20° F.

In a method aspect of this invention, there is provided a method for preparing a printable sheet comprising multiple layers suitable for printing in a heat fusing toner printer, said method comprising:

(a) providing a base sheet having a front face suitable for heat fused toner-based printing;

(b) applying to the front face of the base sheet a thermosensitive, image-forming coating which has a thermally-active, color-forming dye that can be activated at a temperature in the range of 90° F. to 135° F.; and (c) laminating a top sheet to the thermosensitive, image-forming coating. The top sheet has a front face capable of receiving heat fused toner-based print thereon and is of a weight and density which permit sufficient heat to be conducted from a heat fused toner-based image printed on the front face thereof so as to raise the temperature of underlying portions of said thermosensitive, image-forming coating by at least 20° F.

In another aspect of this invention, there is provided a method of forming a duplicate image in a heat fusing toner printer which comprises thermally fusing toner at a temperature greater than 104° F. on a printable sheet to form an image. The printable sheet comprises a base sheet having a front face capable of receiving heat fused toner-based print thereon, a thermosensitive, image-forming coating positioned on the front face of said base sheet, which contains a thermally-activated color-forming dye that can be activated at temperatures in the range of 90° F. to 135° F. and a top sheet having a front face capable of receiving heat fusable toner-based print thereon positioned on the base sheet over said thermosensitive, image-forming coating. The top sheet has a weight and thickness (density) which permits sufficient heat to be conducted from a heat fused toner-based image printed thereon to the thermosensitive, image-forming coating so as to raise the temperature of the underlying portions of the thermosensitive, image-forming coating by at least 20° F. The thermosensitive, image-forming coating is heated to a temperature greater than 90° F. at selected portions by the latent heat of the heat fused toner-based image printed on the front face of the top sheet.

Preferred embodiments of the printable sheet have an integral label associated therewith, and removable therefrom as a top sheet. The thermosensitive, image-forming coating is coated over only a portion of the front face of said base sheet in these embodiments and at least one label laminate is positioned over the thermosensitive, image-forming coating. In selected embodiments, the silicone release layer of the label laminate also functions as the thermosensitive, image-forming coating. The solid silicone layer provides a release face (surface) for the pressure-sensitive adhesive of the label laminate and contains thermally-activated, color-forming dyes which respond to the heat conducted through the face stock and pressure-sensitive adhesive.

Preferred methods of this invention produce a printable sheet, such as a business form of this invention with removable labels, wherein the images formed on said labels are duplicated on the base sheet. This is accomplished by laminating a label laminate to the thermosensitive, image-forming coating, typically before the thermosensitive, image-forming coating cures (dries), as described in U.S. Pat. No. 4,853,256.

In embodiments where the thermosensitive, image-forming coating functions as a release layer of the label laminate, this dual functioning coating is applied to the pressure-sensitive adhesive layer before it is applied to the base sheet. The label laminate formed is applied directly to a base sheet prior to curing the dual functioning coating.

BRIEF DESCRIPTION OF THE DRAWINGS

Various other features and attendant advantages of the present invention will be more fully appreciated as the same becomes better understood when considered in conjunction with the accompanying drawings in which like reference characters designate the same, or similar parts, throughout the several views and wherein:

FIG. 3 is a front view of a printable sheet of FIG. 2;

FIG. 4 is a front view of a printable sheet of FIG. 2 with the label of the label laminate removed.

Figure 1:
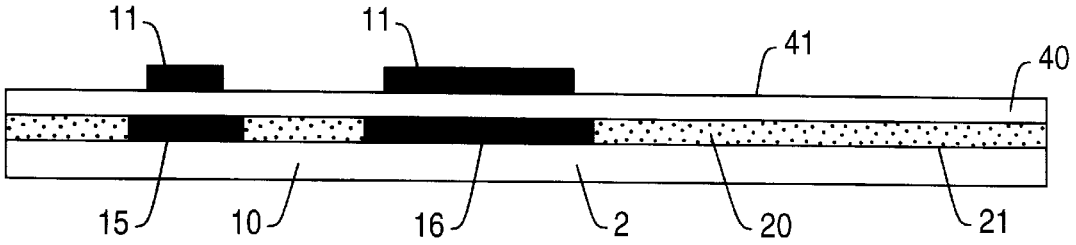
FIG. 1 is a cross-sectional view of a portion of a printable multilayer sheet of the present invention where the top sheet is located.
Figure 2:
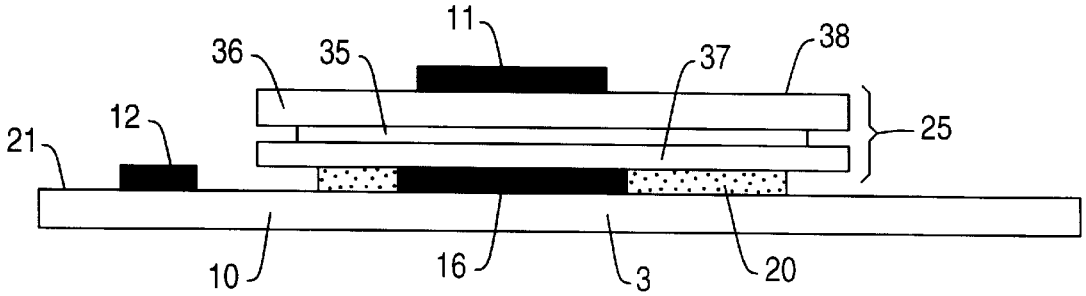
FIG. 2 is a cross-sectional view of a portion of a printable sheet of the present invention where the top sheet is located and said top sheet comprises a label laminate with a removable label.

The thickness of the components in FIGS. 1 and 2 is greatly exaggerated for clarity of illustration.

FIG. 1 illustrates printable sheet 2 with a thermally-fused toner 11 printed thereon. In FIG. 1, base sheet 10 has a front face 21 upon which is positioned thermosensitive, image-forming coating 20. Top sheet 40 is positioned over thermosensitive, image-forming coating 20. Thermally-fused toner 11 is positioned on front face 41 of top sheet 40. The heat from thermally-fused toner 11 has activated portions 15 and 16 of thermosensitive, image-forming coating 20. FIG. 1 shows top sheet 40 aligned with the thermosensitive, image-forming coating 20. However, top sheet 40 may overlap thermosensitive, image-forming coating 20 or be smaller than thermosensitive, image-forming coating 20.

FIG. 2 illustrates printable sheet 3 with a label laminate 25. In FIG. 2, base sheet 10 also has a front face 21 which is suitable for printing heat fusable toner-based image 12 thereon. Thermosensitive, image-forming coating 20 is coated on a portion of front face 21 of base sheet 10. Label laminate 25 is positioned over thermosensitive, image-forming coating 20. Label laminate 25 comprises a pressure-sensitive adhesive layer 35, face stock 36, and silicone release layer 37 positioned over pressure-sensitive adhesive layer 35. Thermally fused toner images 11 and 12 are positioned on front face 38 of face stock 36 and front face 21 of base sheet 10, respectively. The heat from thermally fused toner 11 has activated portion 16 of thermosensitive, image-forming coating 20.

FIG. 3 shows printable sheet 3 of the present invention with base sheet 10 having thermally fused image 12 printed thereon. Label laminate 25 is shown positioned over thermosensitive, image-forming layer 20. Thermally-fused image 11 is positioned on the face stock 36 of label laminate 25.

FIG. 4 shows printable sheet 3 with face stock 36, printed with thermally fused image 11, removed. Base sheet 10 has thermally fused image 12 positioned thereon. Thermosensitive, image-forming coating 20 is also the silicone release layer of the label laminate. Activated portion 16 as a duplicate of image 11.

Base sheet 10 is preferably a base sheet conventionally used in business forms and is typically a commercially available paper but can include specialty papers and other cellulosic materials, such as synthetic polymer materials or cardboard. This includes individual paper sheets, as well as continuous paper rolls and continuous paper fan folds or similar continuous folding arrangements for paper. The paper can be coated or uncoated; however, front face 21 of base sheet 10 must be suitable for printing with a heat fusing toner printer such as a laser printer or photocopy machine.

The thermosensitive, image-forming coating is one that comprises thermally activated, color forming compounds such as thermosensitive dyes, which can be activated at a temperature in the range of 90° F. to 135° F. Preferably, they can be activated at a temperature in the range of 90° F. to 120° F. These ranges define the lowest temperature at which the thermally activated, color forming dyes can be activated. The temperature of activation desired is affected by the weight and thickness (density) of the top sheet, or the label laminate. Suitable thermosensitive dyes are conventional dyes including the leuco dyes described by J. H. Blose et al, in U.S. Pat. No. 3,674,535. Blue color-forming leuco dyes commercially available from Hilton Davis Company, and black-forming dyes of the fluoran group, available from Ciba-Geigy Corporation are also suitable. It is often necessary to employ a temperature modifier within the thermosensitive coating so as to depress the temperature at which the thermally-activated, color-forming dye is activated. Behenyl alcohol is a saturated fatty alcohol used as a temperature modifier, available from Fallack Chemical Co. P-benzyl biphenyl is a hydroxy cyclic compound available from Nagase America Corporation which used as a temperature modifier in a lower temperature range than behenyl alcohol. The thermosensitive, color forming coating may contain a binder such as wax or a synthetic resin. Polyvinyl alcohol is an example of a suitable resin binder for the thermosensitive, color-forming coating. These coatings may also contain fillers such as calcium carbonate or clay. Additives such as defoamers and wetting agents can be introduced to the coating formulation to aid formation of these coatings.

The top sheet must provide a surface that is capable of being printed on by a heat fusing toner printer. The top sheet must also have a weight and thickness (density) which permits sufficient heat to be conducted from a heat fused toner-based image printed thereon to said thermosensitive image-forming coating so as to raise the temperature of the underlying portions of the thermosensitive, image-forming coating by at least 20° F., preferably by at least 30° F. The top sheet is preferably of a very low caliper (minimum thickness) and weight so as to allow heat to transfer therethrough to the underlying thermosensitive coating. Tissue papers commonly used in multilayer direct thermal printing which are uncoated can be used as the top sheet in this invention. U.S. Pat. No. 5,686,159 describes the use of electronic data processing (EDP) grade material with a weight of 18–30 lbs./1,000 sheets (11"×17") as a material used in direct thermal printing. Papers with these weights and thicknesses of less than 1 millimeter are suitable for the top sheet herein. Papers with thicknesses and weights at the low end of this range (18 lbs.) and even lower may be preferred for certain embodiments of this invention in that the thermally fused toner applied in heat fusable toner-based printing processes does not heat substrates with the intensity of the printheads used in direct thermal transfer printers.

The top sheet can comprise a label laminate as mentioned above. This label laminate comprises a face stock, a pressure sensitive adhesive layer and a silicone release layer. This label laminate preferably has a weight and thickness in the ranges described above for the top sheet. The face stock of the label laminate must be printable by a heat fusing toner printer and can be comprised of the low caliper material discussed above. The pressure-sensitive adhesive of the label laminate can be a pressure-sensitive adhesive conventionally used for labels. These include adhesives based on silicone resins, ethyl vinyl acetate copolymers, polyurethanes, polychloroprenes, polybutadienes, butadiene acrylonitrile rubbers, natural rubbers, styrene butadiene rubbers, acrylics, polyisobutylenes, butyl rubbers, higher polyvinyl alkyl ethers, S-B-S block copolymers, polyacrylate esters, vinyl ethers and styrene-isoprene butadiene acrylonitrile polymers. Suitable pressure-sensitive adhesives include hot melt pressure sensitive adhesives. They also can be U.V. curable when desired. Effective hot-melt, silicone resin-based pressure-sensitive adhesives are described in U.S. Pat. No. 5,482,988. Solvent-based pressure-sensitive adhesives, as well as water-borne adhesives, are suitable as well. Suitable solvent-based silicone resin pressure-sensitive adhesives include those described in U.S. Pat. Nos. 4,460,371 and 5,100,976. U.S. Pat. No. 5,489,624 describes suitable hydrophilic polyethylene oxide-based pressure-sensitive adhesives. U.S. Pat. No. 4,647,504 describes suitable adhesive dispersions based on methacrylate styrene and methacrylate polymers. U.S. Pat. No. 5,512,612 describes suitable water dispersable, poly alkoxyl(alkyl) acrylate polymers and U.S. Pat. No. 5,716,701 describes suitable acrylic copolymer emulsions. The amount of pressure-sensitive adhesive employed (coat-weight) is consistent with that employed on conventional labels with lower levels being preferred to minimize thickness. The viscosity of the adhesive also preferably conforms to conventional adhesives used in labels so that the adhesive does not leak when printed on.

The silicone release layer can be a UV cured or an electron beam cured silicone resin or it can be a solvent cured silicone resin. The silicone release layer overlaps the pressure-sensitive adhesive and can coat essentially the entire rear face of the face stock. Preferred U.V. curable silicone resins are epoxy silicones as exemplified in U.S. Pat. Nos. 5,583,185; 5,500,300; and 5,614,640 and acryl-functional silicones as exemplified in U.S. Pat. Nos. 4,665,147; 4,504,629; 4,563,539; 4,503,208; 4,575,546; and 5,179,134. The UV-curable silicone resin preferably contains a curing agent activated by UV or electron beam radiation such as the photoinitiators described in U.S. Pat. No. 4,507,187.

The silicone release layer must be sufficiently cured so as to limit migration of polymers therein into the pressure-sensitive adhesive. This can interfere with the subsequent use of the label. It is preferable that the silicone release layer have less than 4 wt.% extraction, based on the weight of the layer after exposure to hexane.

The silicone release layer may also contain fillers or other additives to enhance performance. Underivatized fumed silica having a particle size less than 200 nanometers is a preferred filler. Examples of suitable particulate silicas include Cab-o-sperse® 2, Cab-o-sperse® 8205, Cab-o-sperse® A105, Cab-o-sperse® P-1175, Cab-o-sperse® S-1019, Cab-o-sperse® P-1010, all available from Cabot Corporation, Tulscola, Ill. The amount of filler preferably ranges from 2–45 wt. %.

The thickness of the solid silicone release layer varies widely and is preferably less than 1 millimeter and most preferably in the range of about 0.05 to 1.0 millimeter. Multiple thin silicone layers may also be applied to add strength where desired.

While the figures show a printable sheet with one top sheet and a base sheet having a thermosensitive, image-forming coating thereon, it is understood that a printable sheet of this invention may comprise more than one sheet with a thermosensitive, image forming coating if sufficient heat can be conducted to it. In addition, more than one label can be positioned on the base sheet, either in a stacked or side by side arrangement.

A method of the present invention provides printable sheets as described above which form duplicate images with a heat fusing toner printer. This method comprises providing a base sheet having a front face suitable for printing with a heat fusing toner printer. The conventional paper substrates and synthetic resin substrates discussed above with respect to the printable sheets of the present invention are suitable. A portion of the top surface of the base sheet is covered with a thermosensitive, image-forming coating. This can be accomplished by conventional means including brushing, spreading, spraying, rolling, extruding and gravure with conventional equipment such as a kiss roll, air knife, or a doctor blade. Flexographic printing methods may be used to apply the thermosensitive, image-forming coating where desired.

A top sheet is then applied to the thermosensitive, image-forming coating so as to adhere thereto. This can be accomplished by applying an adhesive or by applying the top coating prior to drying of the thermosensitive, image-forming coating. Where the top sheet is a label laminate, the label laminates are preferably prepared in advance by applying a pressure-sensitive adhesive to a face stock and over-coating the pressure-sensitive adhesive with a silicone release layer. Suitable pressure sensitive adhesives include those described above with respect to the printable sheets of the present invention. Pressure-sensitive adhesives are selected to provide a viscosity sufficiently high so that it will not leak from the layer either during manufacture or subsequent printing. Following application of the pressure-sensitive adhesive, a curable silicone resin is applied to the pressure-sensitive adhesive which can be a UV- or electron-beam curable silicone resin or a solvent-based silicone resin which is dried. The UV- or electron-beam curable silicone resin is crosslinked with the aid of curing agents. Suitable curable silicone resins include those described above for the printable sheets of the present invention as well as those that are solvent-cured.

A curable silicone resin can be applied by conventional techniques, as in the case of pressure-sensitive adhesive, i.e., through brushing, spraying, coating, extrusion, roller coating, or gravure, by application with a kiss roll, air knife, or doctor blade, such as a Myer rod. Flexographic printing techniques and equipment can also be used. Once applied over the adhesive, the curable silicone resin can be cured to a solid. Multiple layers can be cured simultaneously or sequentially. However, multiple layers are not desired, in that they will insulate the thermosensitive, image-forming coating.

In selected embodiments, the silicone layer can also function as the thermosensitive, image-forming coating wherein the silicone resin contains thermally active, color forming compounds (dyes). For these embodiments, it is preferable to apply the label laminate before the silicone layer is cured so as to adhere to the base sheet.

A method for forming a duplicate image is also provided by this invention wherein a printable sheet as defined above has an image formed thereon by a heat fusing toner printer. Suitable printers are those that employ a toner that is activated at a temperature of from 110° F. and above. These include those of the Hewlett-Packard II, III, IV, and V series, as well as Canon LX-based machines, Canon LBP series machines, and Apple Personal Laserwriters. The heat fusable toner-based image is formed on the top sheet of the printable sheet at a location above the thermosensitive coating. The heat from the heat fused toner-based image will form a duplicate image on the underlying thermosensitive, image-forming coating. Where the top sheet or face stock of the label laminate is removed from the printable sheet, a duplicate image is revealed.

The entire disclosure of all applications, patents, and publications cited above are hereby incorporated by reference. From the foregoing description, one skilled in the art can easily ascertain the essential characteristics of this invention and without departing from the spirit and scope thereof can make various changes and modifications of the invention to adapt it to various usages and conditions.

What is claimed is:

1. A printable multilayer sheet comprising:

(a) a base sheet having a front face;

(b) a thermosensitive, image-forming coating positioned on the front face of said base sheet, said thermosensitive, image-forming coating containing a thermally-activated, color-forming dye which can be activated at a temperature in the range of 90° F. to 135° F.; and (c) a top sheet positioned on said base sheet over said thermosensitive, image-forming coating, wherein said top sheet has a front face capable of receiving heat fused toner-based print thereon, and said top sheet has a weight and thickness which permit sufficient heat to be conducted from a heat fused toner-based image printed thereon to said thermosensitive image-forming coating so as to raise the temperature of underlying portions of the thermosensitive, image-forming coating by at least 20° F.

2. A printable sheet as in claim 1 wherein the weight of the top sheet falls within the range of 18–30 lbs./1000(11"×17") sheets and the thickness of the top sheet is less than 1 millimeter.

3. A printable sheet as in claim 1 wherein the thermally-active, color forming dye can be activated at a temperature in the range of 90° F. to 120° F.

4. A method of preparing a printable sheet as in claim 1 which comprises (a) providing a base sheet having a front face;

(b) applying a thermosensitive, image-forming coating on the front face of said base sheet, said thermosensitive, image forming coating having a thermally-active, color forming dye that can be activated at a temperature in the range of 90° F. to 135° F.;

(c) laminating a top sheet to said thermosensitive, image-forming coating, wherein said top sheet has a front face capable of receiving heat fused toner-based print thereon and is of a weight and thickness so as to conduct sufficient heat from a heat fused toner-based image printed on the front face thereof to raise the temperature of underlying portions of said thermosensitive, image-forming coating by at least 20° F.

5. A method as in claim 4 wherein the top sheet is a label laminate having a face stock, a pressure-sensitive adhesive layer positioned on the back face of said face stock, and a silicone release coating which covers said pressure-sensitive adhesive layer.

6. A method as in claim 4 wherein the label laminate is laminated to the thermosensitive, image-forming coating by applying the label laminate to said thermosensitive, image-forming coating before it is cured.

7. A method as in claim 4 wherein said silicone release coating is also a thermosensitive, image-forming coating, and the label laminate is laminated by curing said silicone release coating on the front face of said base sheet.

8. A method as in claim 4 wherein said thermally-active, color-forming dye is activated at a temperature in the range of 90° F. to 120° F.

9. A printable sheet comprising:

(a) a base sheet having a front face;

(b) a thermosensitive, image-forming coating positioned on the front face of said base sheet, said thermosensitive, image-forming coating containing a thermally-activated, color-forming dye which can be activated at a temperature in the range of 90° F. to 135° F.; and (c) a label laminate positioned on said base sheet over said thermosensitive, image-forming coating, wherein said label laminate comprises a face stock as a top lamina having a front face capable of receiving heat fused toner-based print thereon, a pressure-sensitive adhesive layer positioned on the rear face of said face stock and a silicone release layer which covers said pressure sensitive adhesive, wherein said label laminate is of a thickness and weight which permit sufficient heat to be conducted from a heat fused toner-based image printed thereon to said thermosensitive, image-forming coating to raise the temperature of underlying portions of said thermosensitive, image-forming coating by at least 20° F.

10. A printable sheet as in claim 9 wherein the silicone layer of the label laminate is also the thermosensitive, image-forming coating.

11. A printable sheet as in claim 9 wherein the weight of the label laminate falls within the range of 18–30 lbs./1000 (11"×17") laminate and the thickness of the label laminate is less than 1 millimeter.

12. A printable sheet as in claim 9 wherein the thermally-active, color-forming dye can be activated at a temperature in the range of 90° F. to 120° F.

13. A method of forming a duplicate image in a heat fusing toner printer with a multilayer printable sheet, said method comprising:

thermally-fusing toner on the top sheet of a multilayer printable sheet at a temperature greater than 110° F. with a heat fusing toner printer to form an image, wherein the temperature of the thermally-fused toner is sufficiently high so as to heat the underlying thermosensitive, image-forming coating to a temperature greater than 90° F, said multilayer printable sheet comprising:

(a) a base sheet having a front face;

(b) a thermosensitive, image-forming coating positioned on the front face of said base sheet, said thermosensitive, image-forming coating containing a thermally-activated, color-forming dye which can be activated at a temperature in the range of 90° F. to 135° F.; and (c) a top sheet positioned on said base sheet over said thermosensitive, image-forming coating, wherein said top sheet has a front face capable of receiving heat fused toner-based print thereon.

14. A method as in claim 13 wherein the top sheet is a label laminate.

15. A method as in claim 14 which comprises the additional step of removing the label from said printable sheet.

* * * * *

UNITED STATES PATENT AND TRADEMARK OFFICE

CERTIFICATE OF CORRECTION

PATENT NO. : 6,303,539 B1
DATED : October 16, 2001
INVENTOR(S) : Kosarew, W. T.

It is certified that error appears in the above-identified patent and that said Letters Patent is hereby corrected as shown below:

Title page,
Item [54], "PRINTABLE SHEETS WHICH FORMS DUPLICATE COPIES AND METHODS FOR PRODUCING AND USING SAME", should be -- PRINTABLE SHEET WHICH FORMS DUPLICATE COPIES AND METHODS FOR PRODUCING AND USING SAME --.

Signed and Sealed this

Eighteenth Day of June, 2002

*Attest:*

*Attesting Officer*

JAMES E. ROGAN
*Director of the United States Patent and Trademark Office*